US006210851B1

(12) United States Patent
Srinivasan et al.

(10) Patent No.: US 6,210,851 B1
(45) Date of Patent: Apr. 3, 2001

(54) ELECTROPHOTOGRAPHIC TONER SURFACE TREATED WITH SILICA MIXTURES

(75) Inventors: Satyanarayan A. Srinivasan; Peter S. Alexandrovich, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/451,554

(22) Filed: Dec. 1, 1999

(51) Int. Cl.[7] ..... G03G 9/097
(52) U.S. Cl. ..... 430/110; 430/111
(58) Field of Search ..... 430/110, 111

(56) References Cited

U.S. PATENT DOCUMENTS

| | | | | |
|---|---|---|---|---|
| 3,938,992 | | 2/1976 | Jadwin et al. | 430/120 |
| 3,944,493 | | 3/1976 | Jadwin et al. | 430/109 |
| 4,833,060 | | 5/1989 | Nair et al. | 430/137 |
| 4,965,131 | | 10/1990 | Nair et al. | 430/137 |
| 5,236,622 | | 8/1993 | Yoneda et al. | 516/33 |
| 5,304,324 | | 4/1994 | Yoneda et al. | 252/309 |
| 5,309,324 | | 5/1994 | Hernandez et al. | 361/734 |
| 5,338,353 | | 8/1994 | Uchino et al. | 106/426 |
| 5,350,357 | * | 9/1994 | Anno et al. | 430/111 |
| 5,397,667 | * | 3/1995 | Law et al. | 430/110 |
| 5,451,481 | * | 9/1995 | Law et al. | 430/110 |
| 5,480,755 | * | 1/1996 | Uchiyama et al. | 430/111 |
| 5,800,959 | * | 9/1998 | Ikami | 430/110 |
| 6,001,527 | * | 12/1999 | Ishihara et al. | 430/110 |
| 6,022,661 | * | 2/2000 | Kurose et al. | 430/111 |
| 6,087,059 | * | 7/2000 | Duggan et al. | 430/111 |

OTHER PUBLICATIONS

Schinichi Sata et al., Study on the Surface Properties of Polyester Color Toner, IS&T NIP 13, 149–152 (1997).

Nash, R. & Muller, R.N., The Effect of Toner and Carrier Composition on the Relationship Between Toner Charge to Mass Ratio and Toner Concentration, IS&T NIP 13, 112–122 (1997).

*Technical Bulletin Aerosil®*, No. 27, Nippon Aerosil Co., Ltd.

Nippon Aerosil Co., Ltd., (a joint venture of Degussa–Huls AG and Mitsubishi Materials Corp.), Technical Information, 1–1222–0, pp. 2–5 & 10.

* cited by examiner

*Primary Examiner*—Roland Martin
(74) *Attorney, Agent, or Firm*—Doreen M. Wells

(57) ABSTRACT

An electrostatographic toner comprising toner particles that have been surface treated with a solvent and silica particles having a BET surface area of 40 to 400 $m^2/g$; wherein the solvent is selected from aliphatic alcohols, diols and triols, aliphatic ketones, aliphatic esters, cyclic ethers and aliphatic ethers.

21 Claims, No Drawings

ELECTROPHOTOGRAPHIC TONER SURFACE TREATED WITH SILICA MIXTURES

FIELD OF THE INVENTION

This invention relates generally to electrostatographic imaging and in particular to electrostatographic toner materials surface-treated with silica mixtures.

BACKGROUND OF THE INVENTION

Digital electrostatographic printing products are being developed for printing high quality text and half tone images, hence there is a need to formulate electrostatographic toners and developers that produce improved image quality (See Schinichi Sata, et al., STUDY ON THE SURFACE PROPERTIES OF POLYESTER COLOR TONER, IS&T NIP13, 149–152 (1997) and Nash, R. & Muller, R. N. THE EFFECT OF TONER AND CARRIER COMPOSITION ON THE RELATIONSHIP BETWEEN TONER CHARGE TO MASS RATIO AND TONER CONCENTRATION, IS&T NIP 13, 112–10, (1997)). Surface treatment of toners with fumed silica powders, results in toner and developer formulations that have improved powder flow properties and reproduce text and half tone dots more uniformly without character voids (See, Schinichi Sata, et. al., supra). The improved powder fluidity of the toner or developer can however create unwanted print density in white background areas.

The triboelectric charge of electrostatographic developers changes as prints are made, referred to as the "life" of the developer. This instability in charging level is one of the factors that require active process control systems in electrostatographic printers to maintain consistent image-density from print to print.

There is need in the art for developers that are stable with life and that have the advantage of improved electrostatic transfer and higher density capabilities.

SUMMARY OF THE INVENTION

It has been discovered that the problems outlined above can be overcome by blending toner at 2000–3000 RPM with a mixture of either (a) a combination of ultrafine fumed silica and solvents selected from among aliphatic alcohols, diols and triols, alicyclic alcohols, aliphatic ethers, aliphatic esters, cyclic ethers or (b) a combination of ultrafine fumed silica (See, for example, Technical Bulletin Aerosil No. 27, Nippon Aerosil Co. Ltd.) and larger (0.05–30.0 $\mu$m) silica particles which contain solvents selected from among aliphatic alcohols diols or triols, alicyclic alcohols, aliphatic ethers, aliphatic esters, cyclic ethers. (See, for example, Tadahiro Yoneda, Ibaraki et. al., U.S. Pat. No. 5,236,622). Ultrafine fumed silica has a BET surface area between 40 and 400 $m^2/g$. Larger silica particles are between 0.05 and 30 $\mu$m. The resulting surface-treated toner contains either (a) 0.1 to 5 weight percent and preferably 0.1 to 2 weight % ultrafine fumed silica (based on the weight of untreated toner) and 0.1–5.0 weight % solvent or (b) 0.1 to 5 weight percent and preferably 0.1 to 2 weight % ultrafine fumed silica (based on the weight of untreated toner) and 0.1 to 5 weight %, preferably 0.5 to 3 weight % larger (0.05–30 $\mu$m) silica particles which contain 0.1–5 weight % solvent. Electrostatographic developers made from this toner exhibit low dust levels and lower charge characteristics when compared to either toners that had no surface treatment at all or toners that were treated with only ultrafine fumed silica. The toners of the invention also exhibit lower charge and dust characteristics when compared to toners surface-treated with a combination of ultrafine filmed silica and ultrafine filmed titanium dioxide.

Hence, the present invention describes an electrostatographic toner comprising toner particles that have been surface treated with a solvent and silica particles having a BET surface area of 40 to 400 $m^2/g$; wherein the solvent is selected from aliphatic alcohols, diols and triols, aliphatic ketones, aliphatic esters, cyclic ethers and aliphatic ethers.

Alternatively, the toner of the invention may also be treated with silica particles having a BET surface area of 0.05 to 3.0 mm. Such larger (0.05 to 3.0 mm) silica particles are commercially available already containing the solvent required for the invention. If these are used, no additional solvent is required.

Formulations for surface treated toner have been previously described, but Applicants are aware of no teaching which suggests that a combination of surface treatments, as disclosed herein, can affect the resulting toner performance. Such teaching would be useful in the art.

DETAILED DESCRIPTION OF THE INVENTION

"Dusting characteristics" as used herein, refers to the amounts of uncharged or low charged particles that are produced when fresh replenishment toner is mixed in with aged developer. Developers that result in very low dust levels are desirable. In a printer, replenishment toner is added to the developer station to replace toner that is removed in the process of printing copies. (U.S. Pat. Nos. 3,938,992, 3,944,493) This added fresh toner is uncharged and gains a triboelectric charge by mixing with the developer. During this mixing process uncharged or low charged particles can become airborne and result in background on prints or dust contamination within the printer. A "dusting test" is described herein below to evaluate the potential for a replenishment toner to form background or dust.

"Low charge characteristics" as used herein refers to the ratio of charge to mass of the toner in a developer. Low charged toners are easier to transport through the electrostatographic process, for example from the developer station to the photoconductor, from the photoconductor onto paper, etc. Low charge is particularly important in multi-layer transfer processes in color printers, in order to minimize the voltage above already transferred layers as this maximizes the ability to transfer subsequent layers of toner. However, typically low charge toners also result in significant dust owing to the low charge. Toner dust is uncharged or low-charged toner particles that are produced when fresh replenishment toner is mixed in with aged developer. Developers that result in very low dust levels are desirable. Typically toners that exhibit high charge to mass ratios exhibit low levels of dust, and vice-versa. Toners that exhibit low charge to mass ratios and low dust characteristics are thus desirable. For an 8$\mu$ (volume average) particle size toner, a desirable charge to mass is 10–40 $\mu$C/g and preferably, 20–35 $\mu$C/g.

The number and volume average particle sizes of the toner and the specific surface area of the toners was measured by the Coulter Counter. The Coulter counter determines the number and the size of particles suspended in a conductive liquid by monitoring the electric current between two electrodes immersed in the conductive liquid on either side of a small aperture, through which a suspension of particles is allowed to flow. As each particle flows through the aperture, it changes the impedance between the electrodes and produces an electric pulse of short duration having a magnitude essentially proportional to the particle voulme. The series of pulses are electrically scaled, counted and accumulated in a number of size-related channels, thereby producing a size distribution curve. The Coulter also estimates a specific surface area of the toner particles assuming spherical particles. The specific surface area of the toner was measured by BET via $N_2$ adsorption. A degassed sample of the toner is subjected to a flowing mixture of helium carrier gas and nitrogen adsorbate gas. The amount of $N_2$ adsorbed/desorbed is used with the BET equation to calculate surface area in square meters per gram. The ratio of the BET surface area to the Coulter surface area is used as a measure of the toner shape irregularity. A desirable range of this ratio is 1 to 3. A ratio much less than 1 results in undesirable problems in transferring toner due to high surface forces, whereas a ratio greater than 3 results in a toner with an undesirably large flaking tendency owing to increased inter-particle mechanical interlocking.

The toner of the invention can be made from a polyester binder, with or without pigment, and with or without charge control agent. An exemplary formulation is shown in Table 1

TABLE 1

Toner Formulation

| Component | Parts by weight | Supplier |
|---|---|---|
| Polyester Binder | 100 | Reichold Chemicals Inc. |
| Pigment | 5 | BASF Corporation |
| Charge Control Agent (E88) | 2 | Orient Chemical Corporation |

Polyester binder = Propoxylated Bisphenol-A and Fumaric acid
Pigment = Copper phthalocyanine, pigment blue, 15:3, Lupreton Blue SE1163 Charge
control agent = Aluminum or Zinc salts of di-t-butyl salicylic acid The components were powder blended, melt compounded, ground in an air jet mill, and classified by particle size. The resulting toner has a median volume average particle size of 7.8–8.5 microns.

In one embodiment of the invention, the electrostatographic toner polymer particles were prepared by means of an organic solvent/aqueous chemical process, a process frequently referred to as "limited coalescence" (LC process). In this process, polymer particles having a narrow size distribution were obtained by forming a solution of a polymer in a solvent that is immiscible with water, dispersing the solution so formed in an aqueous medium containing a solid colloidal stabilizer and removing the solvent by evaporation. The resultant particles were then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al. The method involves dissolving a polymer material in an organic solvent and optionally a pigment and a charge control agent to form an organic phase; dispersing the organic phase in an aqueous phase comprising a particulate stabilizer and homogenizing the mixture; evaporating the solvent and washing and drying the resultant product.

Some useful inorganic oxides that were useful as toner surface treatment are:

TABLE 2

Inorganic Oxide Surface Treatments

| Inorganic Oxide | Name | BET Surface area ($m^2/g$) | Average Primary Particle Size (nm) | Reagent | Supplier |
|---|---|---|---|---|---|
| Ultrafine Silica | R972 | 130 ± 25 | 16 | Dichlorodimethylsilane | Degussa |
| Ultrafine Silica | RY200 | 100 ± 20 | 12 | Polydimethylsiloxane | Degussa |
| Ultrafine Titanium Dioxide | T805 | 50 ± 15 | 21 | Octyltrimethoxysilane | Degussa |
| Silica Particles | KE-P-10 | — | 0.11 μm | 6% Methanol, 3% Butanol, | Esprit Chemical Company |

KE-P-10 described in U.S. Pat. No. 5,304,324

In the following examples, polyester toners from propoxylated bisphenol-A and fumaric acid were powder blended, melt compounded, ground in an air jet mill, and classified by particle size. The resulting toner has a median volume average particle size within the range of 0.01–100 μm and preferably 7.8–8.5 microns. The toners were subsequently surface treated by dry blending 2,000 μm of toner with varying amounts of surface treatment agents selected from R972, RY200, T805 and spherical silica particles in a 10 liter Henschel mixer with a 6 element mixing blade. The components were mixed for 5 minutes at a mixing blade speed of 2,000 RPM. The untreated and surface treated toners are described as comparative examples in Tables 3, 4. and 5.

TABLE 3

Comparative Examples Of Surface Treated Toners

| Comparative Example | Toner Weight (gm) | Ultrafine silica R972 particles Weight (gm) | Ultrafine titania T805 particles Weight (gm) | Mixing Time (min) | Mixing Speed (RPM) |
|---|---|---|---|---|---|
| 1 | 2000 | 0 | 0 | 0 | 0 |
| 2 | 2000 | 20 | 0 | 2 | 2000 |
| 3 | 2000 | 20 | 10 | 2 | 2000 |
| 4 | 2000 | 20 | 20 | 2 | 2000 |
| 5 | 2000 | 20 | 40 | 2 | 2000 |
| 6 | 2000 | 0 | 40 | 2 | 2000 |

TABLE 4

Inventive Examples of Surface Treated Toners

| Example | Toner Weight (gm) | Ultrafine silica R972 particles Weight (gm) | Spherical Silica Particles KE-P-10 Weight (gm) | Mixing Time (min) | Mixing Speed (RPM) |
|---|---|---|---|---|---|
| 7 | 2000 | 20 | 10 | 2 | 2000 |
| 8 | 2000 | 20 | 20 | 2 | 2000 |
| 9 | 2000 | 20 | 40 | 2 | 2000 |
| 10 (Comparative.) | 2000 | 0 | 40 | 2 | 2000 |

TABLE 5

Inventive Examples of Surface Treated Toners

| Example | Toner Weight (gm) | Ultrafine silica RY200 particles Weight (gm) | Spherical Silica Particles KE-P-10 Weight (gm) | Mixing Time (min) | Mixing Speed (RPM) |
|---|---|---|---|---|---|
| 11(Comparative) | 2000 | 20 | 0 | 2 | 2000 |
| 12 | 2000 | 20 | 10 | 2 | 2000 |
| 13 | 2000 | 20 | 20 | 2 | 2000 |
| 14 | 2000 | 20 | 40 | 2 | 2000 |
| 15(Comparative) | 2000 | 0 | 40 | 2 | 2000 |

In another embodiment of this invention toners were subsequently surface treated by dry blending 2,000 $\mu$m of toner with varying amounts of ultrafine fumed silica and ethylene glycol. The components were mixed for 2 minutes at a mixing blade speed of 2,000 RPM. The toners are described as examples in Table 6.

TABLE 6

Inventive Examples of Surface Treated Toners

| Example | Toner Weight (gm) | Ultrafine silica RY200 particles Weight (gm) | Ultrafine silica Aerosil 300 particles Weight (gm) | Ethylene glycol (g) | Mixing Time (min) | Mixing Speed (RPM) |
|---|---|---|---|---|---|---|
| 16 (Comparative) | 2000 | 20 | — | — | 2 | 2000 |
| 17 | 2000 | 20 | — | 4 | 2 | 2000 |
| 18 | 2000 | 20 | — | 10 | 2 | 2000 |
| 19 (Comparative) | 2000 | — | 20 | — | 2 | 2000 |
| 20 | 2000 | — | 20 | 5 | 2 | 2000 |
| 21 | 2000 | — | 20 | 10 | 2 | 2000 |
| 22 | 2000 | — | 20 | 15 | 2 | 2000 |
| 23 | 2000 | — | 20 | 20 | 2 | 2000 |

Developer Formulation and Developer Charge Measurement

Electrostatographic developers were prepared by mixing toner with hard magnetic ferrite carrier particles coated with silicone resin. Developers were made at a concentration of 4- to 12 weight % toner, 96 to 88 weight % carrier particles. Carriers were magnetic ferrite carrier particles coated with a polymer such as a silicone resin type polymer, polyvinylidenefluoride, poly(methylmethacrylate), or mixtures of polyvinylidenefluoride and poly (methylmethacrylate).

The developer was mixed on a device that simulated the mixing that Occurs in a printer developer station to charge the toner particles. The triboelectric Charge of the toner was then measured after 2, 10, and 60 minutes of mixing. The Amount of dust was measured at the 10-minute level as mg of toner that dusts off Per gram of admixed fresh toner. The developer was subsequently stripped of all Toner and rebuilt with fresh toner. The triboelectric charge of the toner was then measured after 2 and 10 minutes of mixing. The amount of dust was again measured at the 10-minute level as mg of toner that dusts off per gram of admixed fresh toner.

In a printer, replenishment toner is added to the developer station to replace toner that is removed in the process of printing copies. This toner is uncharged and gains a triboelectric charge by mixing with the developer. During this mixing process uncharged or low charged particles can become airborne and result in background on prints or dust contamination within the printer.

A "dusting test" was performed during experimentation to evaluate the potential for a replenishment toner to form background or dust. The developer sample was exercised on a rotating shell and magnetic core developer station. After 10 minutes of exercising uncharged replenishment toner was added to the developer. A fine filter over the developer station then captured airborne dust that was generated when the replenishment toner was added and the dust collected was weighed. The lower the value for this "dust" measurement the better the toner performance. Typically, low values of dust (less than 10 milligrams per gram of fresh added toner) are desirable.

In Tables 7, 8 and 9 are tabulated the results of the tribocharge and replenishment dust rate tests. Example 1 had no surface treatment. Example 2 was surface treated with R972 silica alone. Examples 3, 4 and 5 were surface treated with a mixture of silica and titanium dioxide (T805). Example 6 was treated with T805 titanium dioxide alone. Examples 7, 8 and 9 were surface treated with a mixture of R972 silica and P-10 silica. Example 10 was treated with P-10 silica alone. Similarly, Example 11 had no surface treatment. Example 12 was surface treated with RY200 silica alone. Examples 13 and 14 were surface treated with a mixture of RY200 silica and P-10 silica. Example 15 was treated with P-10 silica alone.

TABLE 7

Results of Comparative Examples Surface Treated Toners

| Comparative Example | Toner Weight (gm) | Ultrafine silica R972 Weight (gm) | Ultrafine titania T805 Weight, (gm) | FRESH Q/m 2 min μC/g | FRESH Q/m 10 min μC/g | FRESH Q/m 60 min μC/g | FRESH Dust mg | REBUILT Q/m 2 min μC/g | REBUILT Q/m 10 min μC/g | REBUILT Dust mg |
|---|---|---|---|---|---|---|---|---|---|---|
| 1 | 2000 | 0 | 0 | −26 | −54.1 | −72.6 | 32.3 | −29.9 | −52.5 | 15.5 |
| 2 | 2000 | 20 | 0 | −32 | −62.3 | −76.8 | 12.5 | −40 | −61.8 | 8.5 |
| 3 | 2000 | 20 | 10 | −31.7 | −56.2 | −70.6 | 14.7 | −39.3 | −55.9 | 8.3 |
| 4 | 2000 | 20 | 20 | −28.3 | −59.6 | −65.1 | 16.8 | −30.7 | −41.6 | 15.3 |
| 5 | 2000 | 20 | 40 | −23.4 | −50.7 | −50.4 | 29.7 | −23.6 | −24.9 | 30.4 |
| 6 | 2000 | 0 | 40 | −7.5 | −23.5 | −39 | 48.4 | −6.5 | −20.8 | 111.6 |

TABLE 8

Results on Inventive Examples of Surface Treated Toners

| Inventive Example | Toner Weight (gm) | Ultrafine silica R972 Weight (gm) | Silica KE-P-10 Weight, (gm) | FRESH Q/m 2' min | FRESH Q/m 10 min | FRESH Q/m 60 min | FRESH Dust | REBUILT Q/m 2 min | REBUILT Q/m 10 min | REBUILT Dust |
|---|---|---|---|---|---|---|---|---|---|---|
| 7 | 2000 | 20 | 10 | −28.9 | −62.9 | −75.6 | 8.1 | −36.7 | −63.1 | 5 |
| 8 | 2000 | 20 | 20 | −25.4 | −59 | −73.4 | 7.4 | −33 | −53.8 | 6.9 |
| 9 | 2000 | 20 | 40 | −22 | −41.5 | −63.7 | 9.8 | −27.2 | −31.3 | 8.6 |
| 10 comparative | 2000 | 0 | 40 | −12 | −50.6 | −72.3 | 97.2 | −13.4 | −39.4 | 20.5 |

TABLE 9

Results on Examples of Surface Treated Toners

| Inventive Example | Toner Weight, (gm) | Ultrafine silica RY200 Weight (gm) | Silica KE-P-10 Weight (gm) | FRESH Q/m 2 min μC/g | FRESH Q/m 10 min μC/g | FRESH Q/m 60 min μC/g | FRESH Dust mg | REBUILT Q/m 2 min μC/g | REBUILT Q/m 10 min μC/g | REBUILT Dust mg |
|---|---|---|---|---|---|---|---|---|---|---|
| 11 Comparative | 2000 | 20 | 0 | −48.3 | −77.3 | −76.5 | 4.2 | −52.3 | −83.3 | 4.5 |
| 12 | 2000 | 20 | 10 | −46.1 | −66.9 | −82.8 | 3.3 | −52.4 | −74.8 | 2.4 |
| 13 | 2000 | 20 | 20 | −40.9 | −72.1 | −80.9 | 4.2 | −45.1 | −71 | 4 |
| 14 | 2000 | 20 | 40 | −31.2 | −55.2 | −70.8 | 4.7 | −37.2 | −43.4 | 7 |
| 15 comparative | 2000 | 0 | 40 | −12 | −50.6 | −72.3 | 97.2 | −13.4 | −39.4 | 20.5 |

Evaluation of Results

From the results presented in Table 7, it is seen that surface treatment with silica R972 alone (Example 2) increases the absolute value of the rebuilt charge to mass relative to the comparative sample with no surface treatment (Example 1) from −52.5 to −61.8 μC/g. There is a significant lowering of the amount of rebuilt dust to 8.5 mg. It is desirable to lower the absolute Q/m of toners while maintaining the desirable features like flow properties of silica treated toners. The lower Q/m offers advantages of improved transfer and higher image densities. Surface treating toners with either a mixture of silica and T805 titanium dioxide (Examples 3, 4, 5) or titanium dioxide alone (example 6) lowers the 10 minute rebuilt Q/m significantly. However, this is achieved at a severe penalty in the throw-off (dust) amounts, which is undesirable. Thus in Table 7 (Examples 2–5), as the amount of T805 increases the 10-minute rebuilt Q/m decreases in absolute value from −61.8 μC/g to −24.9 μC/g while the amount of admix dust increases from 8.5 mg to 30.4 mg of dust. Treatment with T805 alone (example 6) results in significantly low Q/m (−20.8 μC/g) and large amounts of dust (111.6 mg).

Treatment with a mixture of silica R972 and P-10 silica (Examples 7, 8, 9), as seen in Table 8, results in toner mixtures which not only have lower Q/m, but also lower dust. This is highly desirable because lower charge can be attained without paying the penalty of higher dust. As seen in example 2 (Table 7), treatment with silica R972 alone results in a toner with fairly high Q/m (−61.8 μC/g) and low dust (8.5 mg). As the amount of P-10 increases in inventive examples 7–9 (Table 8), the 10-minute rebuilt Q/m decreases in absolute value from −61.8 μC/g to −31.3 μC/g while the amounts of admix dust is comparable. This behavior is in direct contrast to comparative examples 3–5 (Table 7). Treatment with P-10 alone (example 10 in Table 8) results in significantly higher amounts of dust (20.5 mg)

Similarly, as seen in Table 9, treatment with a mixture of silica RY200 and P-10 silica (Examples 12, 13, 14) results in toner mixtures which have lower Q/m and lower dust and this is highly desirable. As seen in example 11 (Table 9), treatment with silica RY200 alone results in a toner with fairly high Q/m (−83.3 μC/g) and low dust (4.5 mg). As the amount of P-10 increases in inventive examples 12–14 (Table 9), the 10-minute rebuilt Q/m decreases from −83.3 μC/g to −43.4 μC/g while the amounts of admix dust is comparable. In contrast, surface treating with P-10 alone (Example 15) results in increased dust (20.5 mg).

In Table 10 are tabulated the results of the tribocharge and replenishment dust rate tests. Example 16 was surface treated with RY200 silica alone. Examples 17 and 18 was surface treated with a mixture of RY200 silica and ethylene glycol. Examples 19 was surface treated with Aerosil 300 silica alone. Examples 20–23 were treated with a mixture of Aerosil 300 silica and ethylene glycol.

TABLE 10

Results on Inventive Examples of Surface Treated Toners

| Inventive Example | Toner Weight, (gm) | Ultrafine silica RY200 Weight (gm) | Ultrafine silica Aerosil 300 Weight (gm) | Ethylene Glycol (g) | FRESH Q/m 2 min μC/g | FRESH Q/m 10 min μC/g | FRESH Q/m 60 min μC/g | FRESH Dust mg | REBUILT Q/m 2 min μC/g | REBUILT Q/m 10 min' μC/g | REBUILT Dust mg |
|---|---|---|---|---|---|---|---|---|---|---|---|
| 16 comparative | 2000 | 20 | — | — | −48.3 | −77.3 | −76.5 | 4.2 | −52.3 | −83.3 | 4.5 |
| 17 | 2000 | 20 | — | 4 | −23.6 | −68 | −58.8 | 2 | −35.4 | −68.2 | 1.6 |
| 18 | 2000 | 20 | — | 10 | −8.7 | −50 | −44 | 1 | −19.9 | −35.6 | 1.0 |
| 19 comparative | 2000 | — | 20 | — | −26.5 | −58 | −75.9 | 2.5 | −35.9 | −55 | 3.0 |
| 20 | 2000 | — | 20 | 5 | −16.5 | −56.8 | −72.5 | 2.7 | −22.3 | −54.7 | 1.8 |
| 21 | 2000 | — | 20 | 10 | −1.5 | −53 | −58.3 | 4.2 | −4.3 | −47 | 2.2 |
| 22 | 2000 | — | 20 | 15 | −1.3 | −50 | −63.6 | 2.4 | −3.9 | −37.9 | 1.3 |
| 23 | 2000 | — | 20 | 20 | −1.2 | −17 | −28.9 | 17.9 | −3 | −12.3 | 6.0 |

Evaluation of Results

As seen in Table 10, treatment with silica RY200 alone (Example 16) results in a toner with fairly high Q/m (−83.3 μC/g) and low dust (4.5 mg). In the case of toners surface treated with a mixture of RY200 and ethylene glycol solvent (examples 17–18), as the amount of added ethylene glycol increases, the 10-minute rebuilt Q/m decreases from −83.3 μC/g to −35.6 μC/g while the amounts of admix dust is comparable. Similarly, treatment with silica Aerosil 300 alone (Example 19) results in a toner with fairly high Q/m (−55 μC/g) and low dust (3 mg). Surface treating the toners with mixtures of Aerosil 300 and ethylene glycol (examples 20–23) results in toners with low charge (−12.3 μC/g) and low dust (6 mg) characteristics.

What is claimed is:

1. An electrostatographic toner comprising toner particles that have been surface treated with a mixture of silica particles; one type of silica particles having a particle size of 0.05 to 30 μm and containing a solvent selected from aliphatic alcohols, diols, and triols, aliphatic ketones, aliphatic esters, cyclic ethers and aliphatic ethers; and a second type of silica particles having a BET surface area of 40 to 400 $m^2/g$.

2. The electrostatographic toner of claim 1, wherein the silica particles having a BET surface area of 40 to 400 $m^2/g$ are hydrophobic silicas.

3. The electrostatographic toner of claim 1 wherein the silica particles having a BET surface area of 40 to 400 $m^2/g$ comprise 0.1 to 5.0 weight percent of the toner, based on the weight of untreated toner.

4. The electrostatographic toner of claim 1 wherein the silica particles having a BET surface area of 40 to 400 $m^2/g$ comprise 0.1 to 2.0 weight percent of the toner, based on the weight of untreated toner.

5. The electrostatographic toner of claim 1 wherein the silica particles having a particle size of 0.05 to 30.0 μm comprise 0.1 to 5.0 weight percent of the toner, based on the weight of untreated toner.

6. The electrostatographic toner of claim 1 wherein the silica particles having a particle size of 0.05 to 30.0 μm comprise 0.5 to 3.0 weight percent of the toner, based on the weight of untreated toner.

7. An electrostatographic developer comprising the toner described in claim 1 and further comprising at least one carrier particle.

8. The electrostatographic developer as in claim 7 wherein the carrier particle is a ferrite, a magnetites, or a sponge iron.

9. The electrostatographic developer of claim 8 wherein the carrier particle is a ferrite.

10. The electrostatographic developer as in claim 7 wherein the carrier particle is coated with a polymer.

11. An electrostatographic developer as in claim 10 wherein the polymer coating of the carrier particle is a silicone resin type polymer, a poly(vinylidene fluoride), a poly(methyl methacrylate) or a mixture of poly(vinylidene fluoride) and poly(methyl methacrylate).

12. An electrostatographic toner as in claim 1 further comprising a colorant, a charge control agent, or a wax.

13. An electrostatographic toner, surface treated as in claim 1 and prepared by means of an organic solvent/aqueous chemical process.

14. An electrostatographic toner, surface treated as in claim 1 and prepared by means of a limited coalescense process.

15. An electrostatographic toner, surface treated as in claim 1 wherein the solvent is 0.1 to 5.0 weight % based on the weight of untreated toner.

16. A method of making an electrostatographic toner comprising mixing at least one first silica particle having a BET surface area of 40 to 400 $m^2/g$ with at least one second silica particle of a particle size of 0.05 to 30 μm.

17. The method of claim 16 wherein either the first silica particle or the second silica particle is treated with a solvent wherein the solvent is an aliphatic alcohol, diol or triol; aliphatic ketone, aliphatic ester, cyclic ether or aliphatic ether, or combinations thereof.

18. The method of claim 16 wherein the second silica particle is treated with a solvent.

19. The electrostatographic toner according to claim 1, wherein the one type of silica particles having a particle size of 0.05 to 30 μm is a fine inorganic particle silica and the second type of silica particles having a BET surface area of 40 to 400 $m^2/g$ is a fumed silica.

20. The method according to claim 16, wherein the first silica particle having a BET surface area of 40 to 400 $m^2/g$ is a fumed silica and second silica particle having a particle size of 0.05 to 30 $\mu$m is a fine inorganic particle silica.

21. The electrostatographic toner of claim 1, wherein the silica particles having a BET surface area of 40 to 400 $m^2/g$ are hydrophobic silicas.

* * * * *